US006926538B2

(12) United States Patent
Ma

(10) Patent No.: US 6,926,538 B2
(45) Date of Patent: Aug. 9, 2005

(54) BOARD-TO-BOARD ELECTRICAL CONNECTOR ASSEMBLY

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 137 days.

(21) Appl. No.: 10/448,066

(22) Filed: May 28, 2003

(65) Prior Publication Data

US 2004/0185691 A1 Sep. 23, 2004

(30) Foreign Application Priority Data

Mar. 21, 2003 (TW) ..... 92106304 A

(51) Int. Cl.[7] ..... H01R 12/00
(52) U.S. Cl. ..... 439/74
(58) Field of Search ..... 439/74, 660

(56) References Cited

U.S. PATENT DOCUMENTS 5,873,742 A 2/1999 McHugh
5,915,976 A * 6/1999 McHugh ..... 439/74
6,048,213 A * 4/2000 Lai et al. ..... 439/74
6,095,824 A 8/2000 McHugh
6,155,886 A 12/2000 Koseki et al.
6,257,900 B1 * 7/2001 Huang et al. ..... 439/74
6,338,630 B1 * 1/2002 Dong ..... 439/74
6,471,539 B1 * 10/2002 Yu ..... 439/489
6,485,312 B1 * 11/2002 Yu ..... 439/74

* cited by examiner

*Primary Examiner*—Gary Paumen
(74) *Attorney, Agent, or Firm*—Wei Te Chung

(57) ABSTRACT

An electrical connector assembly (1) includes a first connector (11) having a first insulative housing (111) receiving a plurality of first contacts (112) therein and a second connector (12) having a second insulative housing (121) receiving a plurality of second contacts (122) therein. The second housing defines a plurality of second passageways (123) for receiving the second contacts, each second passageway defining a guiding channel (1232) and a receiving channel (1231) communicating with the receiving channel, and the guiding channel having a restricting wall (1233) therein. The second contact defines a second contacting portion (1221) partially protruding into the guiding channel. When the two connectors are mated together, the first contact is inserted into the guiding channel and restricted by the restricting wall and the second contacting portion of the second contact protruding into the guiding channel.

2 Claims, 5 Drawing Sheets

BOARD-TO-BOARD ELECTRICAL CONNECTOR ASSEMBLY

BACKGROUND OF THE INVENTION

1. Field of the Invention

The present invention relates to an electrical connector assembly used for electrically connecting two separate printed circuit boards (PCBs).

2. Description of the Prior Art

Board-to-board electrical connectors have been widely used and applied in all kinds of electrical equipment to electrically connect two separate PCBs. Typical such board-to-board electrical connector assemblies have rectangular housings and contacts received in the housings, and examples thereof are disclosed in U.S. Pat. Nos. 5,873,742, 6,155,886 and 6,095,824.

FIG. 8 shows such a conventional board-to-board electrical connector assembly 7 comprising a first connector 8 and a second connector 9. The first connector 8 comprises a longitudinal first housing 81 and a plurality of first contacts 82 received therein, and the second connector 9 comprises a longitudinal second housing 91 and a plurality of second contacts 92 received therein. The first contacts 82 and the second contacts 92 are symmetrically received in opposite longitudinal sides of the first housing 81 and the second housing 92 respectively. The first and second housings 81, 91 of the two complementary first and second connectors 8, 9 are typically restricted in size by the layouts of corresponding PCBs. That is, the first and second housings 81, 91 are limited to a certain length, and each first and second connector 8, 9 comprises only two rows of first or second contacts 82, 92 therein. Thus, the number of first and second contacts 82, 92 is limited by the structure of the electrical connector assembly 7. The electrical connector assembly 7 is increasingly unable to satisfy the more stringent demands of modern equipment requiring more signal transmission.

Hence, a new board-to-board electrical connector assembly is required to overcome the above-described disadvantages.

SUMMARY OF THE INVENTION

An object of the present invention is to provide a board-to-board electrical connector assembly defining a plurality of rows of high density contacts therein.

In order to achieve the aforementioned object, an electrical connector assembly in accordance with a preferred embodiment of the present invention comprises a first connector having a first insulative housing receiving a plurality of first contacts therein and a second connector having a second insulative housing receiving a plurality of second contacts therein. The second housing defines a plurality of second passageways for receiving the second contacts, each second passageway defining a guiding channel having a restricting wall and a receiving channel communicating with the receiving channel. The second contact defines a second contacting portion partially protruding into the guiding channel. When the two connectors are mated together, the first contact is inserted into the guiding channel and restricted by the restricting wall and the second contacting portion of the second contact protruding into the guiding channel.

Other objects, advantages and novel features of the present invention will become more apparent from the following detailed description when taken in conjunction with the accompanying drawings, in which:

DESCRIPTION OF THE PREFERRED EMBODIMENT

Figure 1:
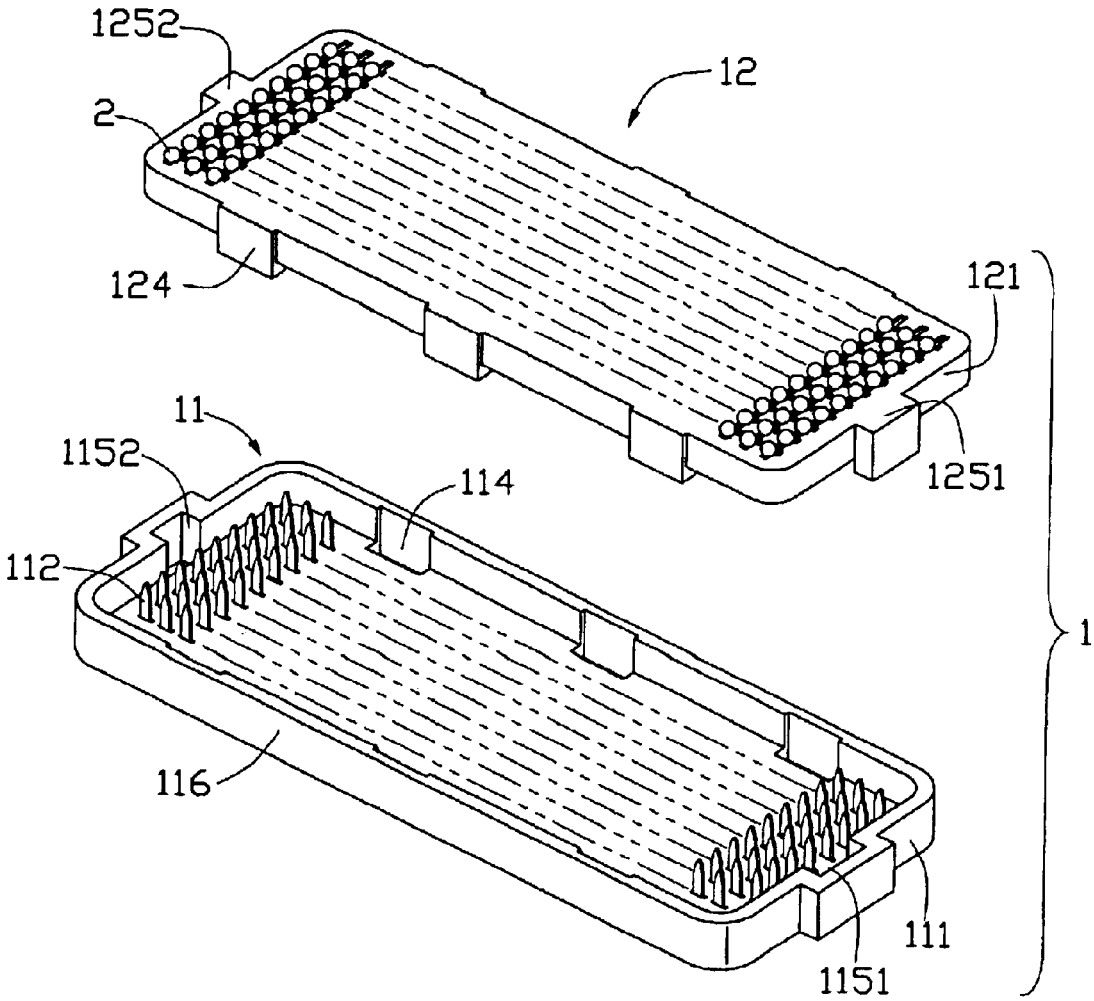
FIG. 1 is a simplified, exploded isometric view of an electrical connector assembly in accordance with the preferred embodiment of the present invention.
Figure 2:
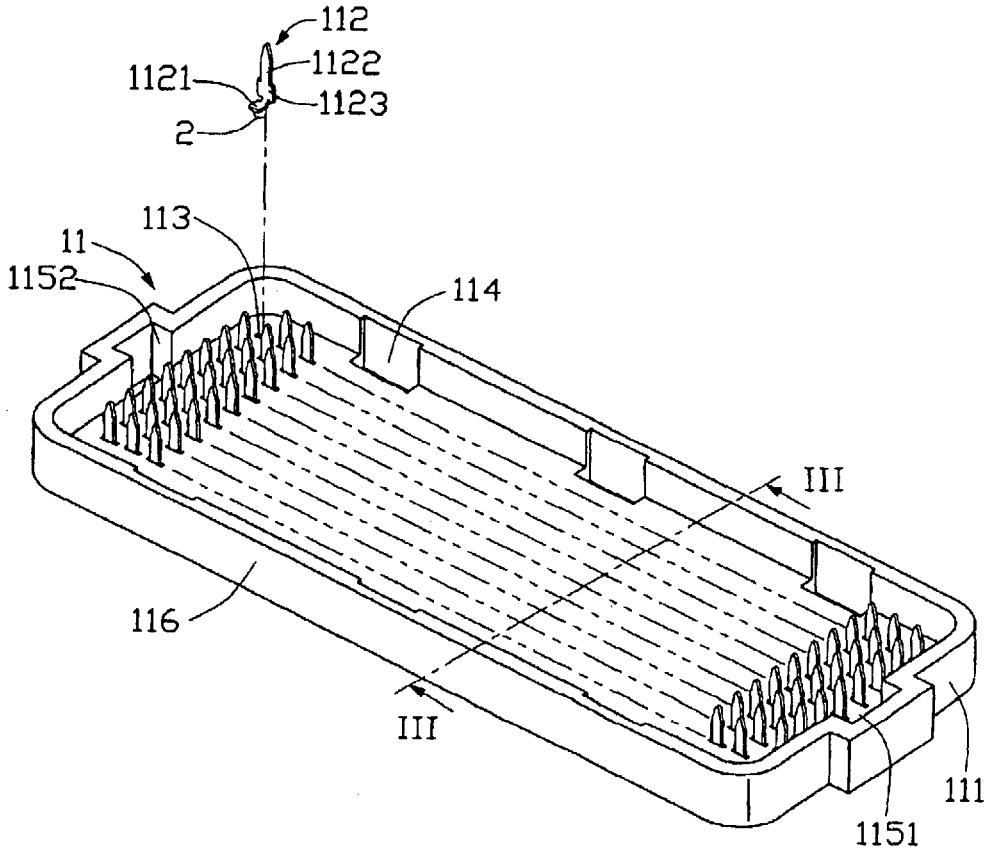
FIG. 2 is an exploded view of a first connector of the electrical connector assembly of FIG. 1.
Figure 3:
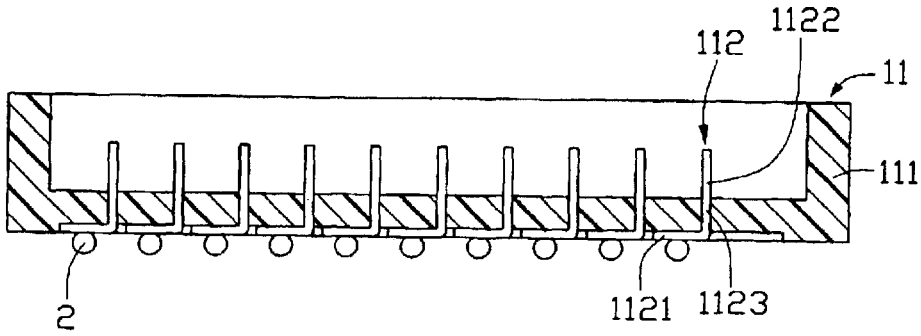
FIG. 3 is a cross-sectional view taken along line III—III of FIG. 2.
Figure 4:
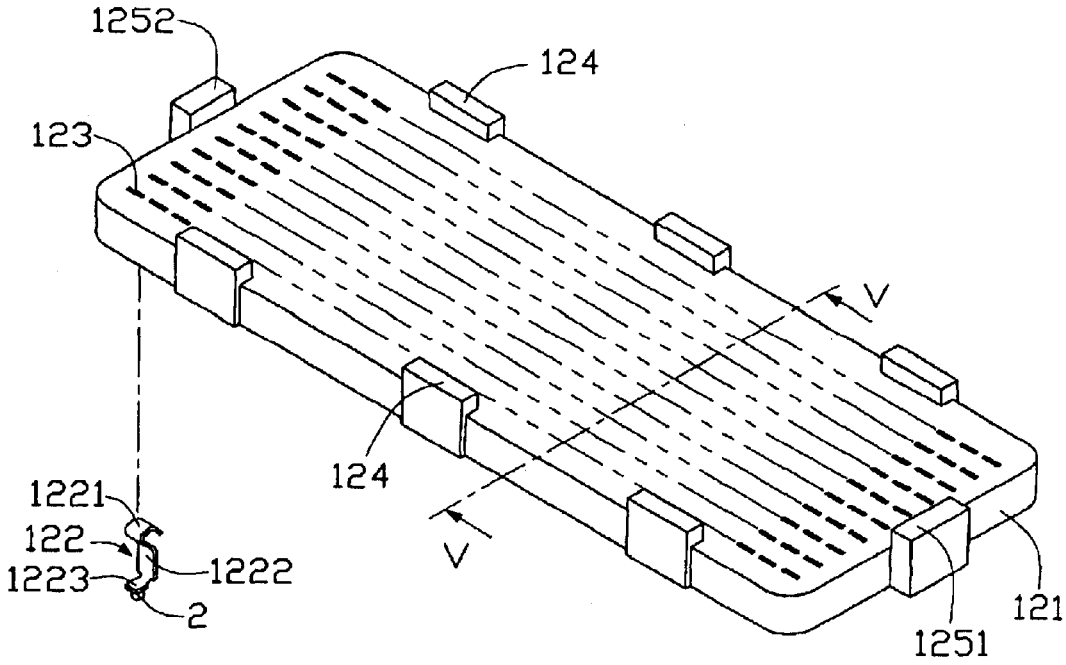
FIG. 4 is an exploded, inverted view of a second connector of the electrical connector assembly of FIG. 1.
Figure 5:
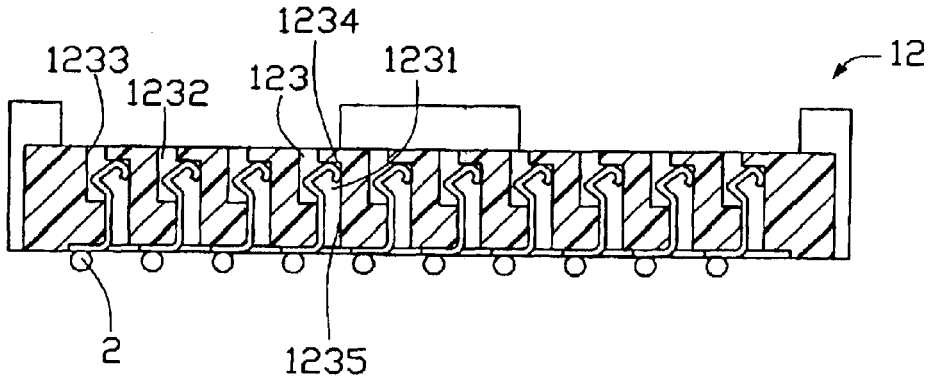
FIG. 5 is a cross-sectional view taken along line V—V of FIG. 4.

Reference will now be made to the drawing figures to describe the present invention in detail.

Referring to FIGS. 1–5, an electrical connector assembly 1 of the present invention comprises a first connector 11 and a second connector 12, each electrically connecting to a respective PCB (not shown). The first connector 11 comprises a longitudinal first housing 111 and a plurality of first contacts 112 received therein, and the second connector 12 comprises a longitudinal second housing 121 and a plurality of second contacts 122 received therein.

The first housing 111 defines multiple rows of first passageways 113, with a peripheral wall 116 surrounding the array of first passageways 113. The peripheral wall 116 defines a plurality of fastening recesses 114 along each of longitudinal inner sides thereof. A first restricting recess 1151 is defined in an end of the peripheral wall 116, and a second restricting recess 1152 is defined in an opposite end of the peripheral wall 116. The first restricting recess 1151 is wider than the second restricting recess 1152 along a transverse direction of the first housing 111.

Each first contact 112 is generally L-shaped, and comprises: a first solder portion 1121 attached a solder ball 2; a first contacting portion 1122 for connecting to a corresponding second contact 122 of the second housing 121; and a first fastening portion 1123 perpendicularly extending from the first solder portion 1121.

The second housing 121 defines multiple rows of second passageways 123 therein, and forms a plurality of fastening blocks 124 corresponding to the fastening recesses 114 of the first housing 111. The second housing 121 also forms a first restricting block 1251 and a second restricting block 1252, for mating in the first restricting recess 1151 and the second restricting recess 1152 respectively of the first housing 111. Each second passageway 123 comprises a receiving channel 1231, and a guiding channel 1232 in communication with the receiving channel 1231. The receiving channel 1231 is bounded by an upper wall 1234, and a sidewall 1235 perpendicular to the upper wall 1234. The guiding channel 1232 is bounded by a restricting wall 1233.

Each second contact 122 comprises a generally arcuate second contacting portion 1221, a second fastening portion 1222 extending from the second contacting portion 1221, a second solder portion 1223 extending from the second fastening portion 1222, and a solder ball 2 attached to a distal face of the second contacting portion 1221. The second contacting portion 1221 and the second fastening portion 1222 are received in a corresponding receiving channel 1231. The second contacting portion 1221 is restricted in the receiving channel 1231 by the upper wall 1234 and the sidewall 1235, and partially protrudes into the guiding channel 1232.

Figure 6:
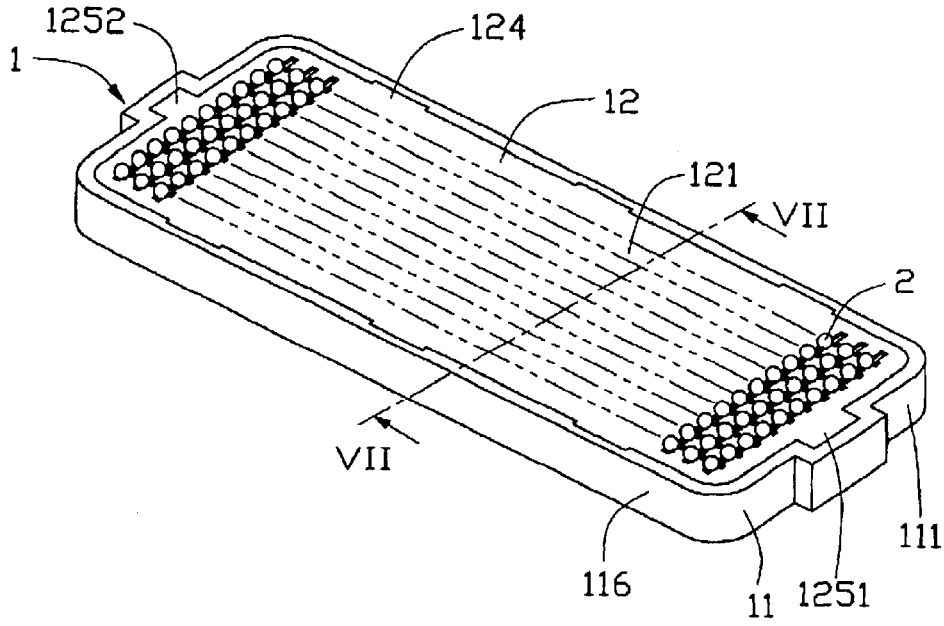
FIG. 6 is an assembled view of FIG. 1.
Figure 7:
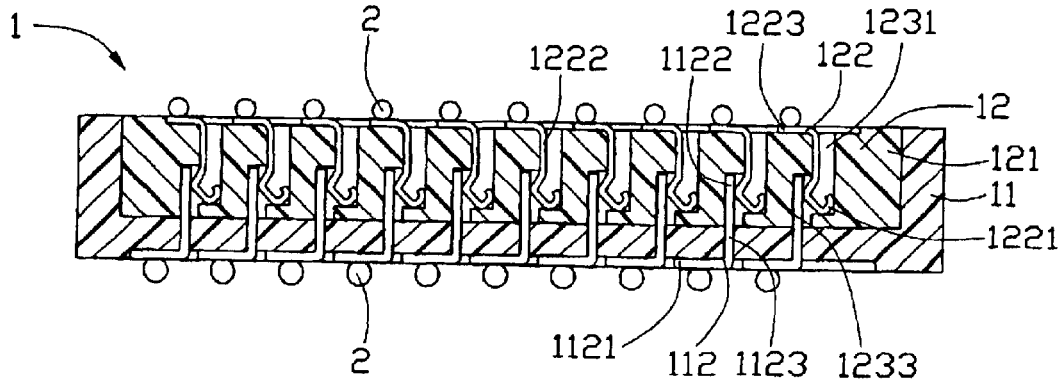
FIG. 7 is a cross-sectional view taken along line VII—VII of FIG. 6.
Figure 8:
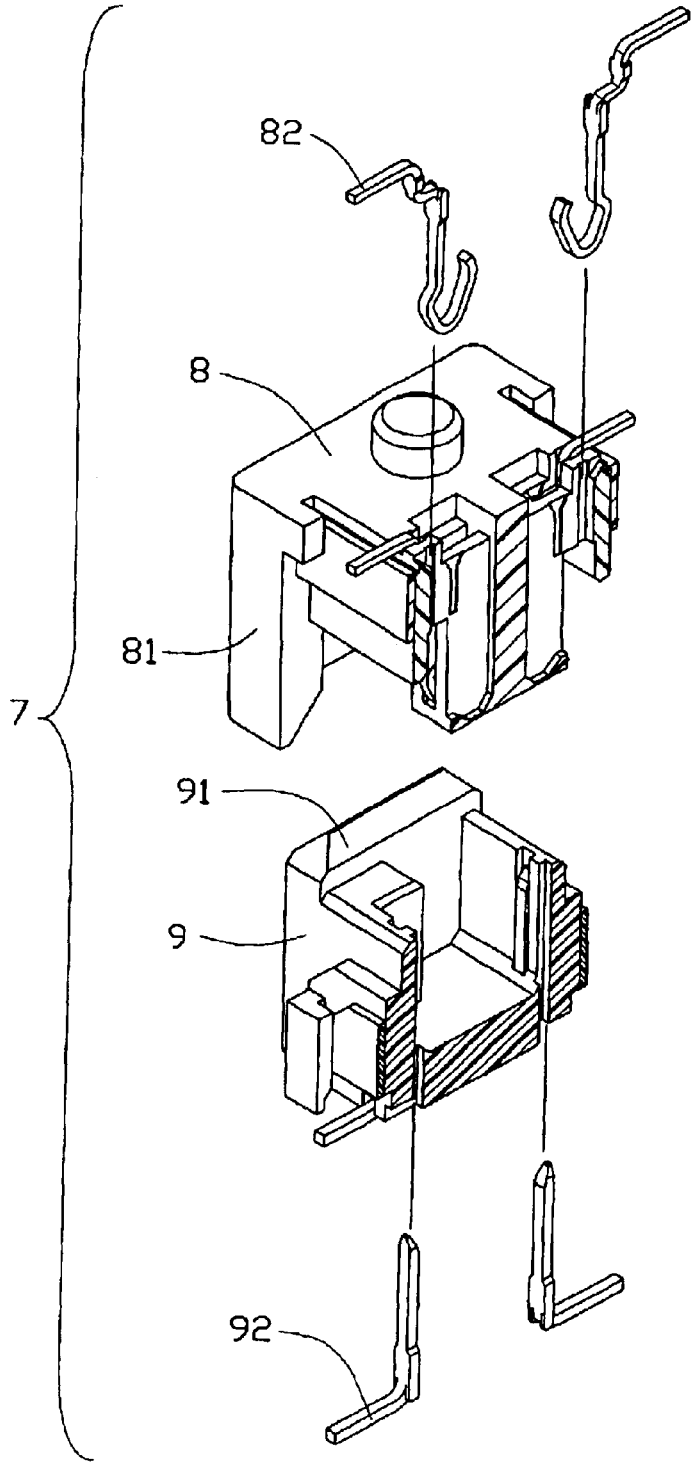
FIG. 8 (PRIOR ART)
FIG. 8 is an exploded, isometric view of part of a conventional electrical connector assembly.

Referring also to FIGS. 6 and 7, when the first connector 11 and the second connector 12 are mated together, the fastening blocks 124, the first restricting block 1251 and the second restricting block 1252 are inserted into the corresponding fastening recesses 114, first restricting recess 1151 and second restricting recess 1152 respectively. Each first contact 112 of the first connector 11 is received into a corresponding guiding channel 1232. The first contacting portion 1122 of the first contact 112 is restricted in the guiding channel 1232 by the restricting wall 1233 and by the second contacting portion 1221 that protrudes into the guiding channel 1232. Thus the first contacting portion 1122 is resiliently and electrically connected to the second contacting portion 1221 of the second contact 122. Moreover, even if the contacting force between the first contacting portion 1122 and the second contacting portion 1221 is greater than the normal force, the first contacting portion 1122 cannot be bent or deformed because of restricting force exerted by the restricting wall 1233.

The first contacts 112 and the second contacts 122 are aligned in the first housing 111 and the second housing 121 in a same vertical direction. This enables multiple rows of the first and second contacts 112, 122 to be closely arranged in respective high density arrays, with reduced space between respective adjacent first and second contacts 112, 122. Thus the first and second housings 111, 121 of a given size can receive a larger number of respective first and second contacts 112, 122 therein.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector assembly comprising:

a first connector comprising a first insulative housing defining a plurality of first passageways;

a plurality of first contacts received in the corresponding first passageways;

a second connector comprising a second insulative housing defining a plurality of second passageways, each second passageway defining a guiding channel and a receiving channel communicating with the receiving channel, the guiding channel being bounded by a restricting wall;

a plurality of second contacts received in the corresponding second passageways, each second contact having a second contacting portion; wherein, the second contact is received in the receiving channel and the second contacting portion partially protrudes into the guiding channel, when the first connector and the second connector are mated, the first contact is inserted into the guiding channel and engages and is restricted by the restricting wall and the second contacting portion protruding into the guiding channel;

wherein the first insulative housing has a plurality of fastening recesses along a longitudinal direction thereof and a plurality of restricting recesses along a transverse direction thereof;

wherein the second insulative housing has a plurality of fastening blocks corresponding to the fastening recesses and a plurality of restricting blocks corresponding to the restricting recesses;

wherein the restricting recesses include a first restricting recess and a second restricting recess, the first restricting recess being wider than the second restricting recess along a transverse direction of the first housing;

wherein the fastening blocks include a first fastening block and a second fastening block for mating in the first restricting recess and the second restricting recess.

2. An electrical connector assembly comprising:

a first connector including:

a first insulative housing defining a large cavity with a top face under said cavity;

a plurality of first contacts disposed in the first housing in matrix and extending upwardly above the top face;

a second connector including:

a second insulative housing snugly received in said large cavity with thereof a top surface abutting against the top face, said second housing defining a plurality of passageways, in matrix, each including a guiding channel and a receiving channel in communication with each other; and a plurality of second contacts disposed in the corresponding receiving channels, respectively, each of said second contacts including a contacting portion laterally protruding into the guiding channel while vertically hidden behind the top surface by a corresponding top wall located above the corresponding receiving channel; wherein when mated, each of said first contacts is inserted into the corresponding guiding channel and engages and is sandwiched between a corresponding restriction wall in said guiding channel and the contacting portion of the corresponding second contact aside.

* * * * *